US005370339A

United States Patent [19]

Moody et al.

[11] Patent Number: 5,370,339

[45] Date of Patent: Dec. 6, 1994

[54] APPARATUS FOR DISPENSING WEB MATERIAL FROM A CORELESS ROLL AND FOR RESISTING END-WISE REMOVAL OF THE ROLL UNTIL SUBSTANTIAL DEPLETION THEREOF

[75] Inventors: John R. Moody, Antioch; Jimmie L. Whittington, Diamond Bar, both of Calif.

[73] Assignee: James River Paper Company, Inc., Richmond, Va.

[21] Appl. No.: 159,535

[22] Filed: Dec. 1, 1993

[51] Int. Cl.[5] ..... B65H 75/18

[52] U.S. Cl. ..... 242/597.6; 242/573.9; 242/597.3; 242/599.4

[58] Field of Search ..... 242/55.2, 55.3, 55.42, 242/55.54, 68, 68.3, 68.5, 68.6, 563.2, 596.7, 597.3, 597.6, 599.4, 573.1, 573.9, 576; D6/518, 521, 522, 523

[56] References Cited

U.S. PATENT DOCUMENTS

| | | | |
|---|---|---|---|
| D. 246,021 | 10/1977 | Richards | D6/91 |
| 3,612,423 | 10/1971 | Bahnsen | 242/55.42 |
| 3,792,822 | 2/1974 | Underhill | 242/55.3 |
| 4,212,434 | 7/1980 | Walker | 242/55.2 |
| 4,235,389 | 8/1980 | Ness | 242/55.2 |
| 4,248,391 | 2/1981 | Ness | 242/55.54 |
| 4,314,678 | 2/1982 | Upchurch | 242/55.2 |
| 4,878,631 | 11/1989 | Tanovici | 242/55.2 |
| 4,984,915 | 1/1991 | Tashiro et al. | 242/55.2 X |
| 5,135,179 | 8/1992 | Morano | 242/55.54 |

*Primary Examiner*—Daniel P. Stodola
*Assistant Examiner*—John Q. Nguyen
*Attorney, Agent, or Firm*—Thomas R. Lampe

[57] ABSTRACT

Apparatus for dispensing web material from a coreless roll of such material includes a fixed shaft having a spindle rotatably mounted thereon. The spindle is axially movable relative to the shaft. The spindle includes at least one dog which is cammed outwardly when the spindle is moved axially relative to the shaft to tightly engage the innermost convolution of a coreless roll mounted on the shaft and spindle to resist endwise removal of the coreless roll.

16 Claims, 2 Drawing Sheets

APPARATUS FOR DISPENSING WEB MATERIAL FROM A CORELESS ROLL AND FOR RESISTING END-WISE REMOVAL OF THE ROLL UNTIL SUBSTANTIAL DEPLETION THEREOF

TECHNICAL FIELD

This invention relates to apparatus for dispensing web material from a coreless roll of such material. The invention has particular application to dispensing paper from a coreless paper roll having a plurality of convolutions and a central opening defined by the innermost convolution. The apparatus incorporates structure which deters against theft of a coreless roll until it has been substantially depleted.

BACKGROUND ART

It is known in the prior art to form and make available coreless rolls of toilet tissue, paper toweling and the like. Such products incorporate no inner core and are comprised wholly of a plurality of convolutions of the paper itself. A central opening is defined by the innermost roll of convolution and the central opening can accommodate spindles and shafts to support the roll as it is dispensed by being unwound by a consumer.

Of course, if some means is not provided to prevent end-wise movement of the roll relative to the support spindle or shaft, the roll may be removed in its entirety simply by manually pulling it end-wise from the spindle or shaft.

One approach for preventing end-wise removal of a coreless roll from its support is to position the roll and support within the confines of a cabinet. Cabinets, however, add to the cost of the dispenser, may be inconvenient to service, and are not always appropriate for use.

Mechanisms have been devised for the purpose of resisting end-wise removal of a roll product from its support. U.S. Pat. No. 3,792,822, issued Feb. 19, 1974, for example, discloses a tissue roll holder including a support member adapted for fixed mounting to a wall and a sleeve rotatably and permanently mounted thereon, the sleeve being provided with a plurality of sharp prongs for penetration of and locking engagement with the tubular core of a conventional roll of tissue placed thereon to prevent removal of the roll.

The device of U.S. Pat. No. 3,792,822 is inappropriate for use with coreless paper rolls such as coreless toilet tissue rolls and paper towel rolls. The prongs illustrated in the patent, due to their sharp and relatively shallow nature, would engage only a very few inner convolutions of a coreless roll and cause them to tear upon application of minimal end-wise force on the roll by a person attempting to remove the roll from its support. Also, the prongs can possibly injure a person using or servicing the device.

A search directed to the present invention located the following United States patents: U.S. Pat. No. 4,235,389, issued Nov. 25, 1980, U.S. Pat. No. 4,984,915, issued Jan. 15, 1991, U.S. Pat. No. 4,248,391, issued Feb. 3, 1981, U.S. Pat. No. 4,878,631, issued Nov. 7, 1989, U.S. Pat. No. 5,135,179, issued Aug. 4, 1992, U.S. Pat. No. 3,612,423, issued Oct. 12, 1971, U.S. Pat. No. 4,212,434, issued Jul. 15, 1980, U.S. Pat. No. 4,314,678, issued Feb. 9, 1982, and U.S. Pat. Des. 246,021, issued Oct. 11, 1977.

The above-identified patents do not address the problems discussed above and solved by the present invention.

DISCLOSURE OF INVENTION

The apparatus of the present invention is for dispensing web material, such as paper, from a coreless roll comprised of a plurality of convolutions of web material and having a central opening defined by the innermost convolution of the web material.

The invention provides for ease of installation of the coreless roll on the apparatus so that the coreless roll can be dispensed by unwinding in the conventional manner but resists end-wise movement of the coreless roll on a support shaft and spindle until the roll has been substantially depleted during normal use by one or more consumers, i.e., by virtue of unwinding of the coreless roll.

The invention is characterized by its simplicity, reliability and relatively low cost. No external cabinet structure is required to deter against theft of other than a stub roll comprised of very few convolutions.

The apparatus of the present invention is for dispensing web material from a coreless roll comprised of a plurality of convolutions of web material and having a central opening defined by the innermost convolution of the web material.

The apparatus includes support means and a shaft connected to the support means and projecting outwardly therefrom, the shaft having a distal end.

The apparatus also includes a spindle for positioning into the central opening of a coreless roll to mount a coreless roll on the apparatus. The spindle defines a hollow spindle interior and i.e. rotatably mounted on the shaft with the shaft located in the hollow spindle interior.

The spindle is axially slidable relative to the shaft between a first position and a second position, said spindle being closer to the support means when in the second position than when in the first position.

The spindle includes a spindle body and coreless roll lock means movably mounted relative to the spindle body and engageable with the innermost convolution of a coreless roll when the spindle and the shaft are positioned in the central aperture of a coreless roll.

The spindle and the shaft are cooperable to move the lock means outwardly when the spindle is slid axially relative to the shaft from the second position toward the first position to tighten the engagement between the lock means and the innermost convolution of a coreless roll mounted on the apparatus.

The coreless roll lock means includes at least one dog for engaging the innermost convolution of a coreless roll.

The at least one dog has a slanted surface facilitating sliding movement of a coreless roll relative to the dog when the coreless roll is being manually mounted on the spindle and moved toward the support means.

The shaft defines an indent on the periphery of the shaft and said at least one dog is in at least partial registry with the indent and at least partially disposed within the indent when the spindle is in the second position and the spindle is positioned in the central aperture of a coreless roll.

Other features, advantages, and objects of the present invention will become apparent with reference to the following description and accompanying drawings.

MODES FOR CARRYING OUT THE INVENTION

Figure 1:
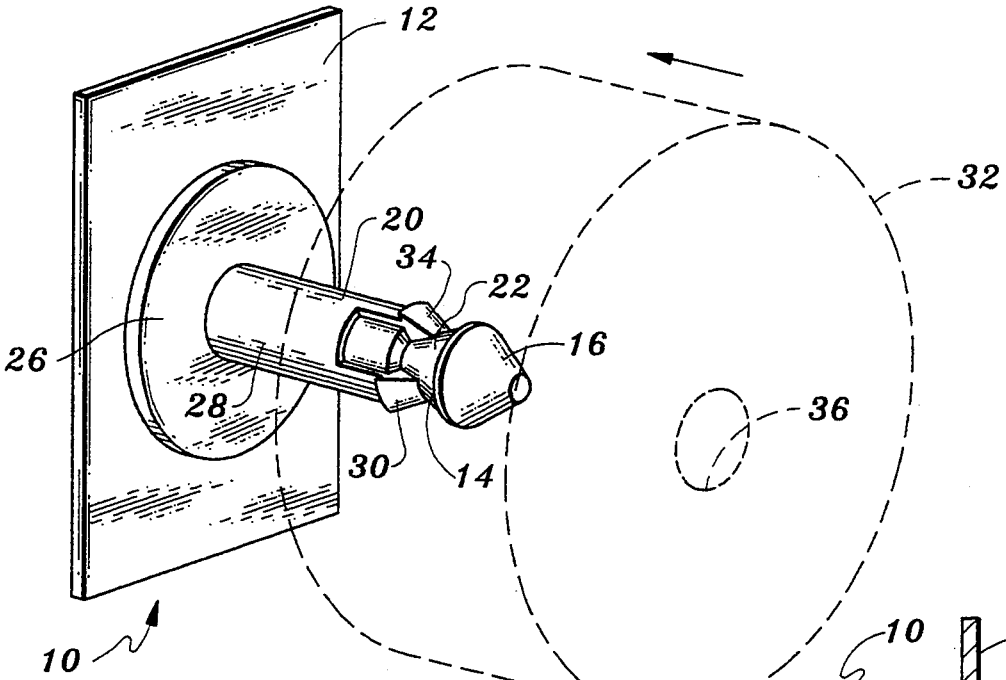
FIG. 1 is perspective view of apparatus constructed in accordance with the teachings of the present invention illustrating installation of a full coreless paper roll thereon.

Referring now to FIGS. 1–6, apparatus constructed in accordance with the teachings of the present invention is designated by reference numeral 10. Apparatus 10 includes a support member 12 in the form of a flat plate.

Support member 12 may be affixed at any desired location, such as a wall, by conventional fastener means (not shown).

A shaft 14 is affixed to support 12 and projects outwardly from the support member. Shaft 14 has a distal end in the form of an enlarged head 16 which is tapered at the outermost extent thereof to facilitate mounting of a coreless roll of web product such as a roll of toilet tissue 32 on the apparatus. This mounting procedure will be described in greater detail below.

A spindle 20 is rotatably mounted on shaft 14 and is coaxial therewith, the spindle having a hollow spindle interior which is slightly larger in cross-section than the cross-section of the shaft at the location of the spindle.

Shaft 14 defines an indent 22 which extends about the periphery of the shaft and is partially defined by a cam surface 24 extending about the shaft and inwardly from head 16.

Spindle 20 includes a spindle body 28 and coreless roll lock means in the form of three dogs 30. Dogs 30 are integrally connected to spindle body 28. An integral flange 26 is located at one end of spindle body 28.

Figure 4:
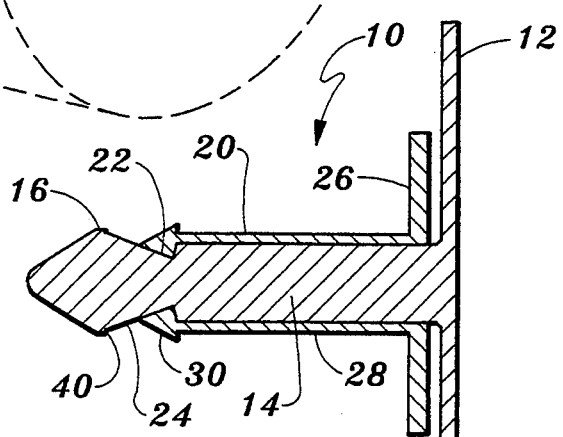
FIG. 4 is a cross-sectional view of the apparatus taken along the line 4—4 in FIG. 2.
Figure 2:
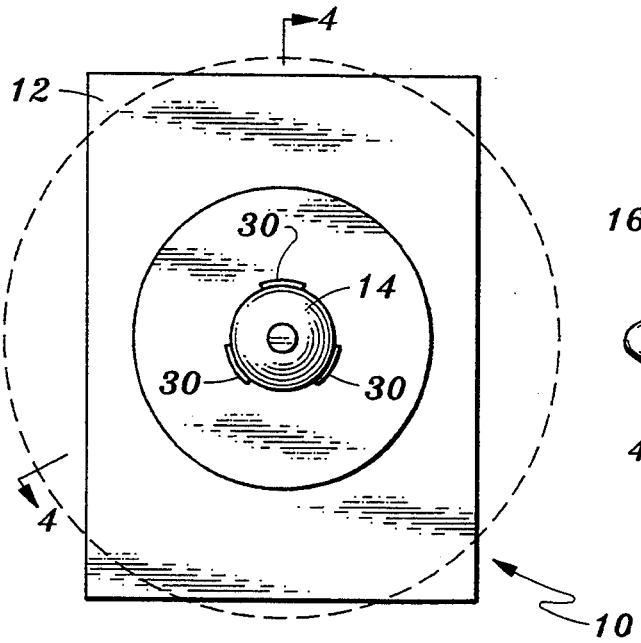
FIG. 2 is a front, elevation view of the apparatus.
Figure 3:
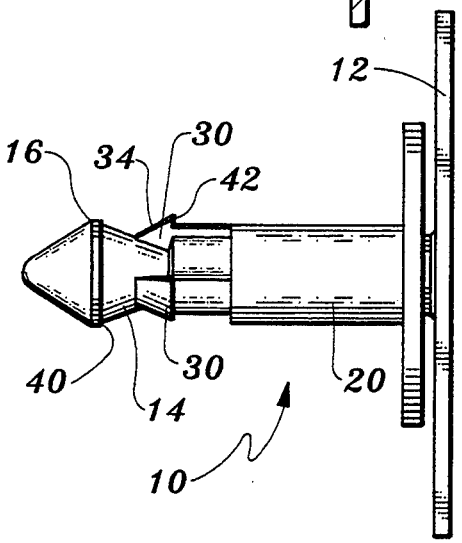
FIG. 3 is a side, elevation view of the apparatus.

In the absence of outside forces being applied thereto, dogs 30 will occupy the positions shown in FIGS. 1, 3 and 4. However, the dogs are free to flex relative to the spindle body and will move outwardly in a flaring formation if sufficient force is applied to the dogs urging them in the outward direction.

The spindle 20 is axially slidably movable relative to shaft 14 when a roll 32 is being mounted on the shaft and spindle. The roll is slipped over tapered head 16 of the shaft and slid over the dogs and spindle body of the spindle. It will be noted that the doge have a slanted surface 34 which will facilitate sliding movement of the coreless roll 32 relative to the dogs when the coreless roll is being manually mounted on the spindle and moved toward the support means 12. Insofar as the mounting operation is concerned, the coreless roll 32 has a central opening 36 into which the shaft and spindle are positioned. Since the roll is coreless, the innermost convolution of the roll defines the central or center hole of the roll.

Figure 5:
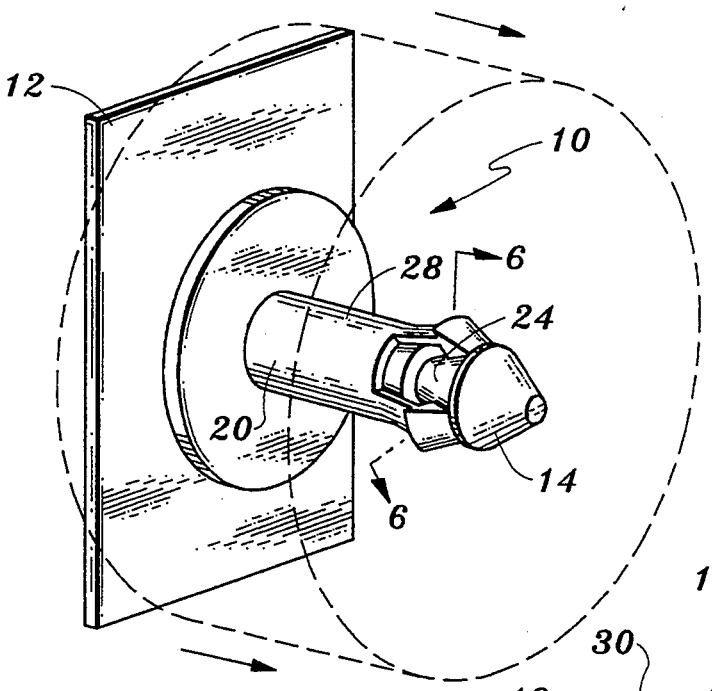
FIG. 5 is a view similar to FIG. 1, but illustrating expansion of the dogs of the apparatus upon application of an end-wise pulling force on the roll mounted on the apparatus.
Figure 6:
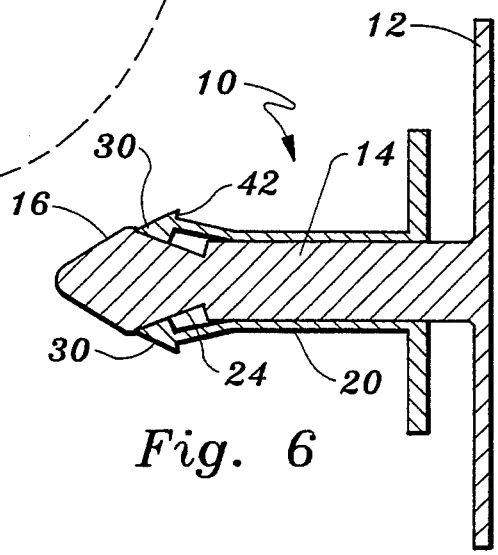
FIG. 6 is a cross-sectional view taken along the line 6—6 in FIG. 5.

If one were to exert a pulling force on the roll 32 after it has been mounted in position on apparatus 10, such pulling force will cause the spindle 20 to move from its position shown in FIGS. 1, 3 and 4 to that illustrated in FIGS. 5 and 6. Such movement will cause the dogs 30 to flex relative to the spindle body and move or flare outwardly as they ride upon cam surface 24 of shaft 14. This will tighten the engagement of dogs 30 with the innermost convolutions of roll 32 and make it extremely difficult for the person attempting such removal to complete the task.

Outward movement of the spindle will be halted altogether due to engagement of the dogs 30 with an abutment 40 formed on head 16. It will be noted that inwardly disposed surface 42 of each dog is substantially at right angles to the primary axes of the shaft and the spindle. Thus, maximum resistance is provided by the dog to an outwardly directed axial pulling force on roll 32. The surfaces 34, 42 of the dog converge to form a pointed projection in the arrangement illustrated.

Removal of a stub roll can be accomplished, if desired, once the roll of material has been reduced to a diameter substantially equal to the diameter of flange 26. An individual can restrain spindle 20 from forward movement by holding the flange in its rearward position. The stub roll can then be stripped from the spindle.

Figure 7:
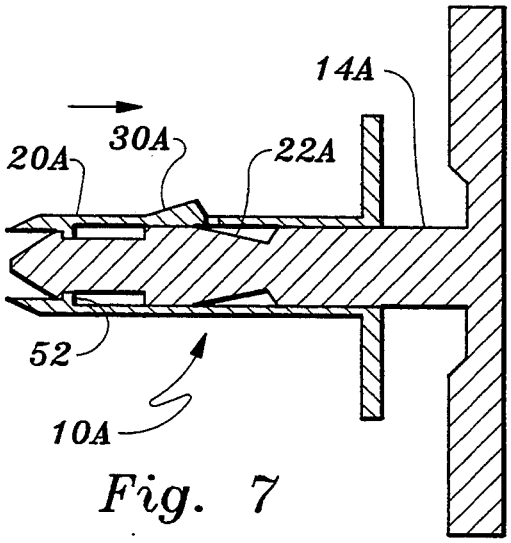
FIG. 7 is a view similar to FIG. 4, but illustrating an alternative embodiment of the invention.
Figure 8:
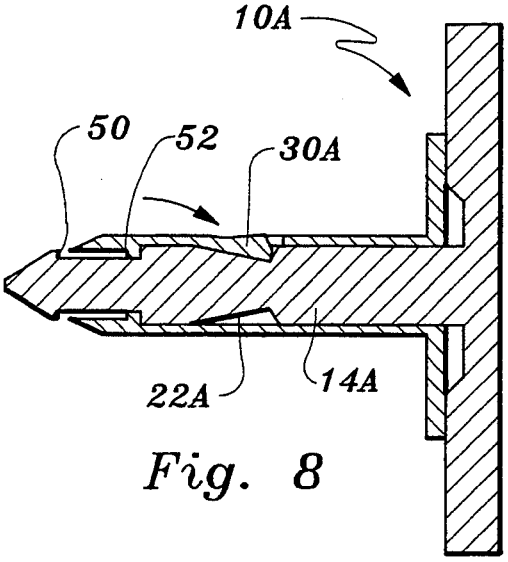
FIG. 8 is a view similar to FIG. 7, but illustrating the dogs of the alternative embodiment positioned in a recess of the apparatus shaft.

FIGS. 7 and 8 show an alternative embodiment of the invention. Apparatus 10A essentially operates in the same manner as apparatus 10 described above. However, in apparatus 10A the shaft 14A has an indent 22A located approximately mid-length of the shaft rather than at the end thereof. Indent 22A is for accommodating a dog 30A comprising part of spindle 20A in much the same manner that previously described indent 22 accommodated dogs 30.

Outward movement of spindle 20A caused by exerting an outwardly directed axial force on a roll (not shown) on the spindle end shaft will cause the spindle to slide from the FIG. 8 position to the FIG. 7 position. This will cause dog 30A to cam outwardly and "bite" into the roll to prevent its removal.

Shaft 14A has a distal end with an abutment surface 50 which is engaged by a stop 52 on the spindle 20A to terminate outward movement of the spindle 20A relative to shaft 14A.

We claim:

1. Apparatus for dispensing web material from a coreless roll comprised of a plurality of convolutions of web material and having a central opening defined by the innermost convolution of said web material, said apparatus comprising, in combination:

shaft support means for supporting a shaft;

a shaft supported by said shaft support means, projecting outwardly from said shaft support means and supported by said shaft support means, said shaft having a distal end; and a spindle for positioning into the central opening of a coreless roll to mount a coreless roll on said apparatus, said spindle having a hollow spindle interior and being rotatably mounted on said shaft with said shaft located in said hollow spindle interior, said spindle being axially slidable relative to said shaft between a first position and a second position, said spindle being closer to said shaft support means when in said second position than when in said first position, said spindle including a spindle body and coreless roll lock means for locking a roll, said roll lock means movably mounted on said spindle body and engageable with the innermost convolution of a coreless roll when said spindle and said shaft are positioned in the central aperture of a coreless roll, said spindle and said shaft including means cooperable with an end-wise movement of said roll on said spindle to move said lock means outwardly away from said spindle body when said spindle is slid axially relative to said shaft from said second position toward said first position to tighten the engagement between said lock means and the innermost convolution of a coreless roll mounted on said apparatus to resist end-wise movement of said coreless roll on said spindle body.

2. The apparatus according to claim 1 wherein said coreless roll lock means includes at least one dog for engaging the innermost convolution of a coreless roll.

3. The apparatus according to claim 2 wherein said shaft defines an indent on the periphery of said shaft, said at least one dog being in at least partial registry with said indent and at least partially disposed within said indent when said spindle is in said second position and said spindle is positioned in the central aperture of a coreless roll.

4. The apparatus according to claim 3 wherein said indent extends about the periphery of said shaft and is at least partially defined by a cam surface engageable by said at least one dog when said spindle is slid axially relative to said shaft from said second position toward said first position to cam said at least one dog away from said shaft and into tight locking engagement with the innermost convolution of a coreless roll mounted on said apparatus.

5. The apparatus according to claim 3 wherein said spindle has opposed ends, said at least one dog being located between said opposed ends.

6. The apparatus according to claim 2 wherein said coreless roll lock means includes a plurality of dogs radially disposed about said spindle body for engaging the innermost convolution of a coreless roll.

7. The apparatus according to claim 2 wherein said at least one dog as integral with said spindle body and flexibly connected to said spindle body.

8. The apparatus according to claim 2 wherein said at least one dog includes a radially outwardly disposed pointed projection, said pointed projection being defined by first and second dog surfaces converging relative to each other.

9. The apparatus according to claim 8 wherein said spindle and shaft have primary axes and said second dog surface is at a substantially right angle to the primary axes of said shaft and said spindle.

10. The apparatus according to claim 2 wherein said spindle has opposed ends, said at least one dog being located at one of said opposed ends.

11. The apparatus according to claim 2 wherein said at least one dog has a slanted surface facilitating sliding movement of a coreless roll relative to said dog when the coreless roll is being manually mounted on said spindle and moved toward said support means.

12. The apparatus according to claim 1 wherein said shaft distal end is tapered to facilitate entry of said shaft into the central aperture of a coreless roll being mounted on said apparatus.

13. The apparatus according to claim 1 including spindle movement limiting means for limiting axial movement of said spindle relative to said shaft.

14. The apparatus according to claim 13 wherein said spindle movement limiting means includes an abutment on said shaft and engageable by said spindle.

15. The apparatus according to claim 14 wherein said abutment is located at said shaft distal end.

16. The apparatus according to claim 1 wherein said spindle body includes a projection manually engageable to prevent movement of said spindle from said second position to said first position to allow manual end-wise removal of a stub roll from said spindle.

* * * * *